US012006785B2

(12) United States Patent
Biernacik

(10) Patent No.: US 12,006,785 B2
(45) Date of Patent: Jun. 11, 2024

(54) SELF-PROPELLED VALVE ACTUATOR ON A RAIL TRANSPORT SYSTEM FOR MANIFOLDS AND SUBSEA TREES

(71) Applicant: Vetco Gray Scandinavia AS, Stavanger (NO)

(72) Inventor: Dawid Biernacik, Stavanger (NO)

(73) Assignee: Vetco Gray Scandinavia AS, Stavanger (NO)

( * ) Notice: Subject to any disclaimer, the term of this patent is extended or adjusted under 35 U.S.C. 154(b) by 0 days.

(21) Appl. No.: 17/907,052

(22) PCT Filed: Mar. 17, 2021

(86) PCT No.: PCT/EP2021/025107

§ 371 (c)(1),
(2) Date: Sep. 22, 2022

(87) PCT Pub. No.: WO2021/190787

PCT Pub. Date: Sep. 30, 2021

(65) Prior Publication Data

US 2023/0111005 A1 Apr. 13, 2023

(30) Foreign Application Priority Data

Mar. 27, 2020 (NO) ..... 20200365

(51) Int. Cl.

| | |
|---|---|
| ***E21B 34/04*** | (2006.01) |
| ***E21B 33/03*** | (2006.01) |
| ***E21B 33/035*** | (2006.01) |

(52) U.S. Cl.

CPC ..... *E21B 34/04* (2013.01); *E21B 33/0355* (2013.01)

(58) Field of Classification Search

CPC ..... E21B 34/04; E21B 33/0355

See application file for complete search history.

(56) References Cited

U.S. PATENT DOCUMENTS

| | | | | |
|---|---|---|---|---|
| 3,777,812 | A | 12/1973 | Burkhardt et al. | |
| 7,165,619 | B2 | 1/2007 | Fox | |
| 9,174,286 | B1 | 11/2015 | Smith | |
| 10,570,701 | B2 | 2/2020 | Robinson et al. | |
| 10,669,819 | B2 * | 6/2020 | Miller | E21B 19/008 |
| 11,136,846 | B2 * | 10/2021 | Jamieson | E21B 34/04 |

(Continued)

FOREIGN PATENT DOCUMENTS

| | | |
|---|---|---|
| CN | 205733660 | 11/2016 |
| CN | 10864446 | 10/2018 |

(Continued)

OTHER PUBLICATIONS

International Search Report and Written Opinion dated Jun. 29, 2021 in corresponding PCT Application No. PCT/EP2021/025107.

(Continued)

*Primary Examiner* — Aaron L Lembo

(74) *Attorney, Agent, or Firm* — Hogan Lovells US LLP

(57) ABSTRACT

The invention relates to a self-propelled valve actuator on a rail transport system for manifolds and Christmas trees. The valve actuator is moveable along a transport rail and may operate several valves. The valve actuator is driven by a gearwheel motor. The invention also relates to a rotatable valve head having diametrical slots with which the valve actuator may interact.

12 Claims, 6 Drawing Sheets

(56) References Cited

U.S. PATENT DOCUMENTS

| | | | | |
|---|---|---|---|---|
| 2018/0187522 | A1 | 7/2018 | Ceccon De Azevedo | |
| 2022/0010658 | A1* | 1/2022 | Angstmann | B25J 9/04 |
| 2022/0099389 | A1* | 3/2022 | Fernandez | F28F 13/06 |

FOREIGN PATENT DOCUMENTS

| | | | |
|---|---|---|---|
| CN | 108915617 | | 11/2018 |
| GB | 2566038 | A | 3/2019 |
| KR | 20140107760 | A | 9/2014 |
| WO | 90/03489 | | 4/1990 |
| WO | 96/08675 | A1 | 3/1996 |
| WO | 2017/198536 | | 11/2017 |

OTHER PUBLICATIONS

Ajith Kumar & Sigurd Moe, "Subsea Electric Systems Enter a New Era," FMC Technologies, Subsea Controls Down Under, Perth, WA—Oct. 2016, https://www.sut.org/wp-content/uploads/2015/09/Ajith-Kumar-Subsea-Electric-Solutions-Enter-a-New-Era-1.pdf, 22 pages.

Examination Report dated Aug. 30, 2023 from Great Britain Patent Office in corresponding GB Application No. GB2215148.4.

Examination Report dated Oct. 17, 2023 from Australia Patent Office in corresponding AU Application No. AU2021240803.

Office Action dated Oct. 1, 2020 from Norwegian Patent Office in corresponding NO Application No. 20200365.

* cited by examiner

SELF-PROPELLED VALVE ACTUATOR ON A RAIL TRANSPORT SYSTEM FOR MANIFOLDS AND SUBSEA TREES

FIELD OF THE INVENTION

The present invention relates to a self-propelled valve actuator on a rail transport system for manifolds and subsea trees.

BACKGROUND

Subsea trees and manifolds normally include multiple valves, each requiring an actuator e.g. a tool to open and close the valve. Manifolds and subsea trees are equipped with one dedicated valve actuator per valve or are adapted to allow ROVs or other external equipment to be used to actuate the valves. ROV operations are costly and time consuming and there is a drive towards replacing ROV operation with local solutions on the seabed, typically operated remotely by an operator top side. The valves may also be controlled automatically based on various operating parameters. The actuators can also be connected to a hydraulic system than can be actuated via a Subsea Control System. However, it is a challenge to present a reliable system for controlling the large number of valves being necessary to operate a subsea oilfield in a reliable manner. The present invention seeks to reduce the number of required actuators by introducing a remotely controlled valve actuator able to operate multiple valves on a manifold or subsea tree, thereby reducing the cost and complexity of subsea installations. Another aspect of the invention is to provide a safe, simple and reliable valve actuator by introducing a rail transport system for the valve actuator.

SUMMARY OF THE INVENTION

The invention relates to a production structure valve actuator system for actuating at least two valves on the production structure having at least two valves, each valve comprising a rotatable valve head. The production structure valve actuator system comprises a transport rail, a valve actuator moveable along the transport rail, the valve actuator including at least a first gearwheel engaging a transport rail rack of the transport rail, an actuator motor housing, a rotatable drive element with a valve head engagement portion for engaging the valve head, and at least one motor for driving at least one of the gearwheel and the drive element.

The invention also relates to said valve actuator system, wherein the production structure is a Christmas tree or manifold.

The invention also relates to said valve actuator system, wherein the valve actuator motor housing is liquid filled.

The invention also relates to said valve actuator system, wherein the valve head engagement portion includes a first end portion and a second end portion, each with chamfered corners.

The invention also relates to said valve actuator system, wherein the valve head includes either one single diametrical slot or $2^{n-1}$ diametrical slots where n=[2, 3, 4, . . . ] with an angle of $180°/2^{n-1}$ between each diametrical slot; and wherein an end surface of the valve head engagement portion is parallel to a base surface of the diametrical slots of the valve head.

The invention also relates to said valve actuator system, wherein each diametrical slot includes two inclined cut-away portions expanding the slot width towards the circumference of the cylindrical valve head at both ends of the slot.

The invention also relates to said valve actuator system, wherein the valve actuator includes a magnetic sensor, monitoring the position of the valve actuator along the transport rail.

The invention also relates to said valve actuator system, wherein the valve head engagement portion is a flat blade.

The invention also relates to said valve actuator system, wherein the transport rail is secured to the production structure.

The invention also relates to said valve actuator system, including a second valve actuator identical to the above described valve actuator.

The invention also relates to a valve actuator as such, and a valve head as such.

DETAILED DESCRIPTION OF THE INVENTION

Figure 1:
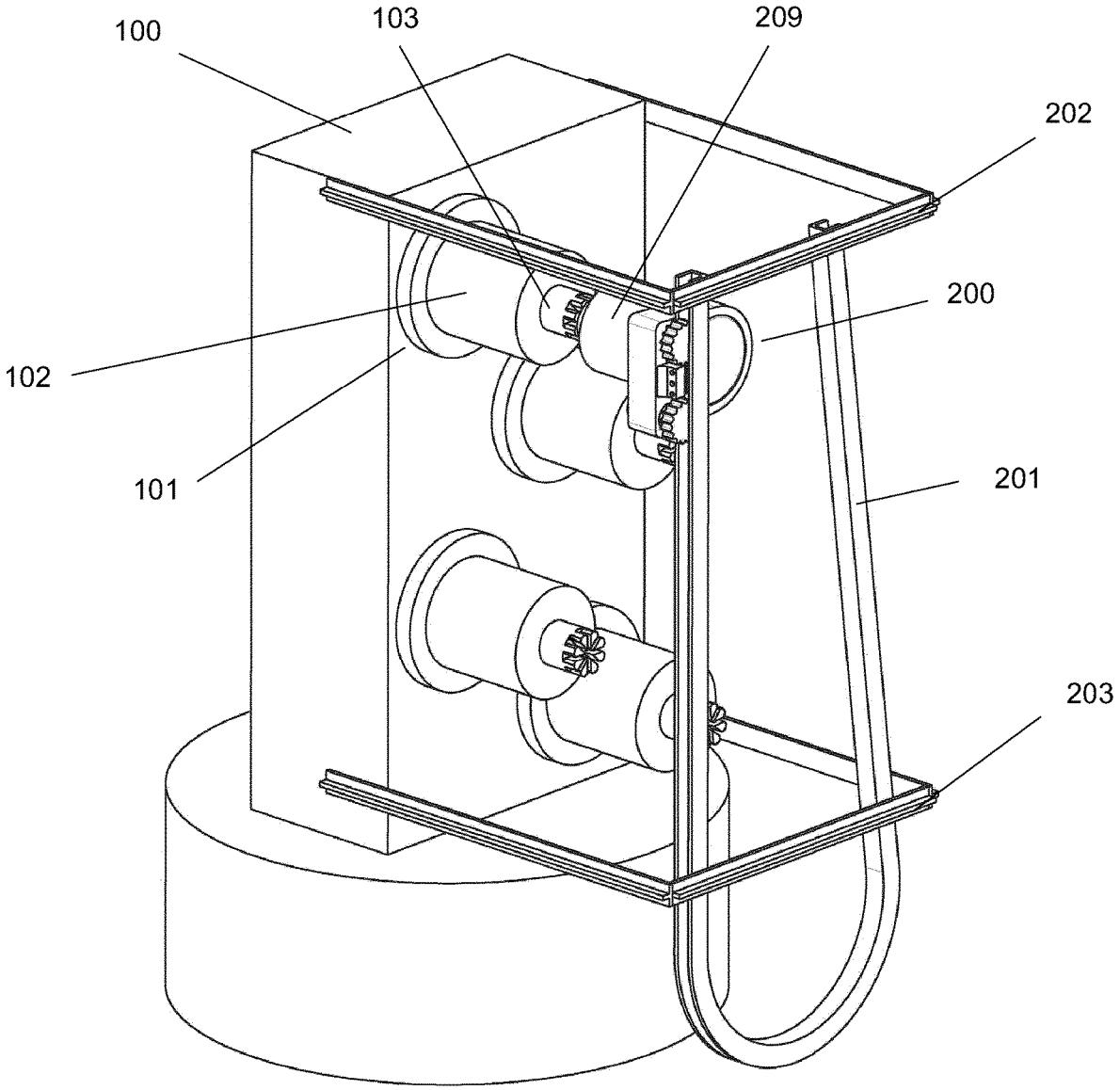
FIG. 1 is a perspective view of a valve actuator according to the invention installed on a manifold including valves.

FIG. 1 is a perspective view of a valve actuator 200 installed on a production structure 100 including several valves 101. The production structure 100 can be a manifold, a Christmas tree, a subsea tree or any other structure containing multiple valves. It should be noted that only a small section of the production structure 100 is shown on the drawings of this disclosure. The valve actuator 200 can be remotely operated.

In the embodiment of FIG. 1 four valves are included, but the production structure 100 may include any number of valves. Each valve 101 has a valve housing 102 and a valve head 103 for operating the valve 101. The valve actuator 200 is connected to and moveable along a transport rail 201. The transport rail 201 forms a path in alignment with the four valves so that the valve actuator 200 may engage each valve 101. The transport rail 201 is fixed to the production structure 100 via a first support frame 202 and a second support frame 203. The valve actuator 200 includes an actuator motor housing 209 extending towards the production structure 100 and the valves 102.

The transport rail 201 may be U-shaped such as the transport rail 201 shown in FIG. 1, creating a space saving path for operating the valves along its pathway. The transport rail 201 can be of any other shape (not shown), e.g. straight, circular, looped, S-shaped etc., suitable for a valve configuration other than that of FIG. 1.

Alternatively, two separate valve actuators may be mounted to the transport rail 201. In case of failure of an actuator, the other actuator can push the redundant actuator to a parking position. Two actuators on one rail may also share the workload by operating different valves simultaneously.

The valve actuator 200 is driven by at least one electrical motor. Power may be supplied via internal power communication means within the transport rail and/or via power communication means connected to the valve actuator 200. The valve actuator 200 may be powered by a subsea battery pack or by a power source topside. The valve actuator 200 may be operated from topside.

The valves may include a mechanical spring release system and an electromechanical brake internally to hold the valve head 103 in place.

Figure 2:
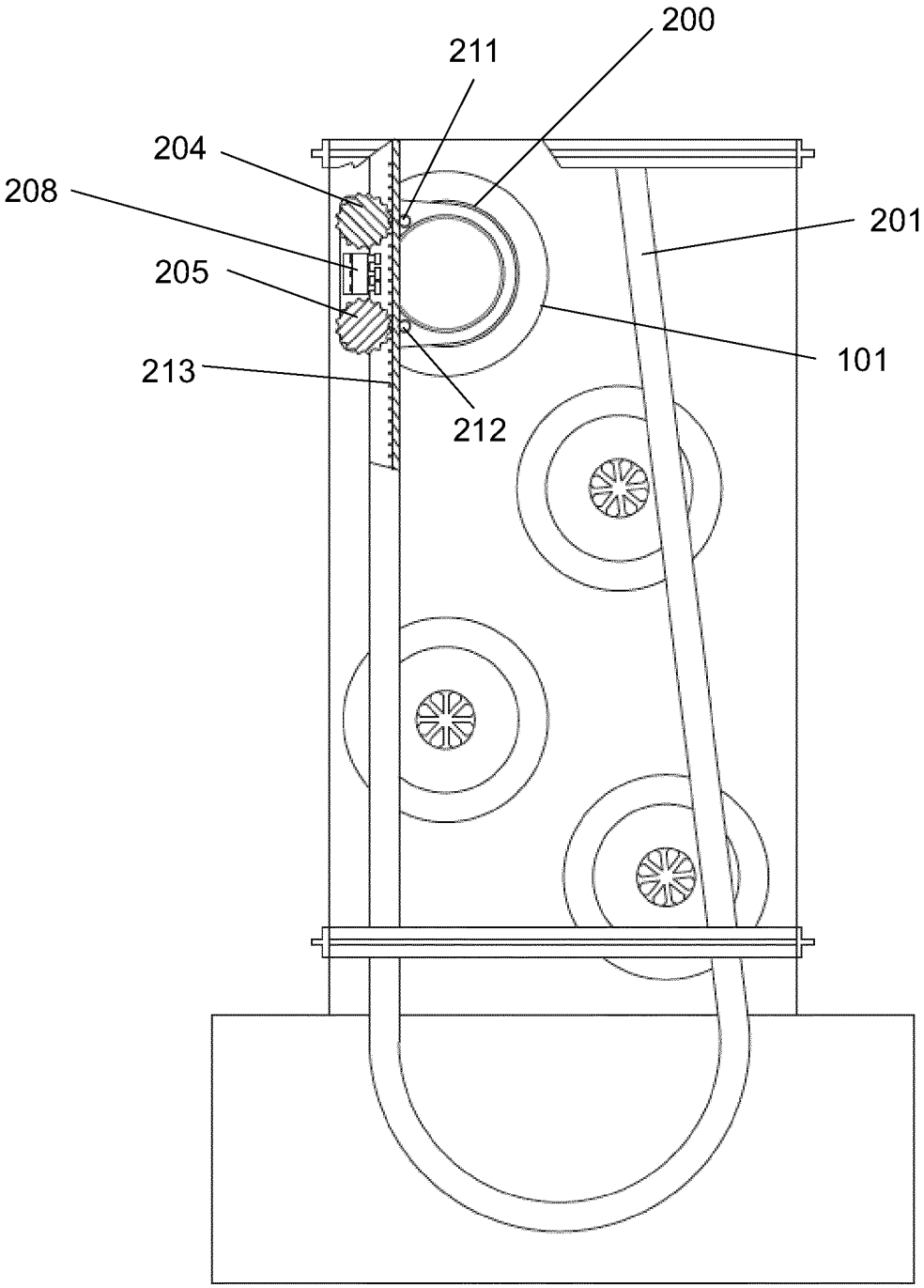
FIG. 2 is an elevation of FIG. 1 where a portion of the transport rail is cut away.

FIG. 2 is an elevation of FIG. 1 where an upper part of the transport rail 201 is cut away. FIG. 2 discloses a first gearwheel 204 and a second gearwheel 205 of the valve actuator 200 engaged with a transport rail rack 213 fixed to or integrated in the transport rail 201, the transport rail rack 213 extending the length of the transport rail 201. At least one of the first gearwheel 204 and the second gearwheel 205 drives the actuator along the transport rail 201 in a forward or backward direction in order for the valve actuator 200 to be placed in a position of engagement with each valve.

A first support pin 211 is fixed to the valve actuator 200 and is located adjacent to the first gearwheel 204, the transport rail 201 being located between the first support pin 211 and the first gearwheel 204. A second support pin 212 is fixed to the valve actuator 200 and is located adjacent to the second gearwheel 205, the transport rail 201 being located between the second support pin 212 and the second gearwheel 205. The first support pin 211 and the second support pin 212 hold the valve actuator 200 upright and aligned with the transport rail 201.

The valve actuator 200 further includes a support clamp 208 located between the first gearwheel 204 and the second gearwheel 205 holding the valve actuator 200 upright and aligned with the transport rail 201.

The valve actuator also includes a magnetic sensor (not shown) in communication with magnetic components (not shown) of the transport rail 201 sensing the position of the valve actuator 200 along the transport rail 201. The valve actuator 200 position is communicated to a controller (not shown) topside.

Figure 3:
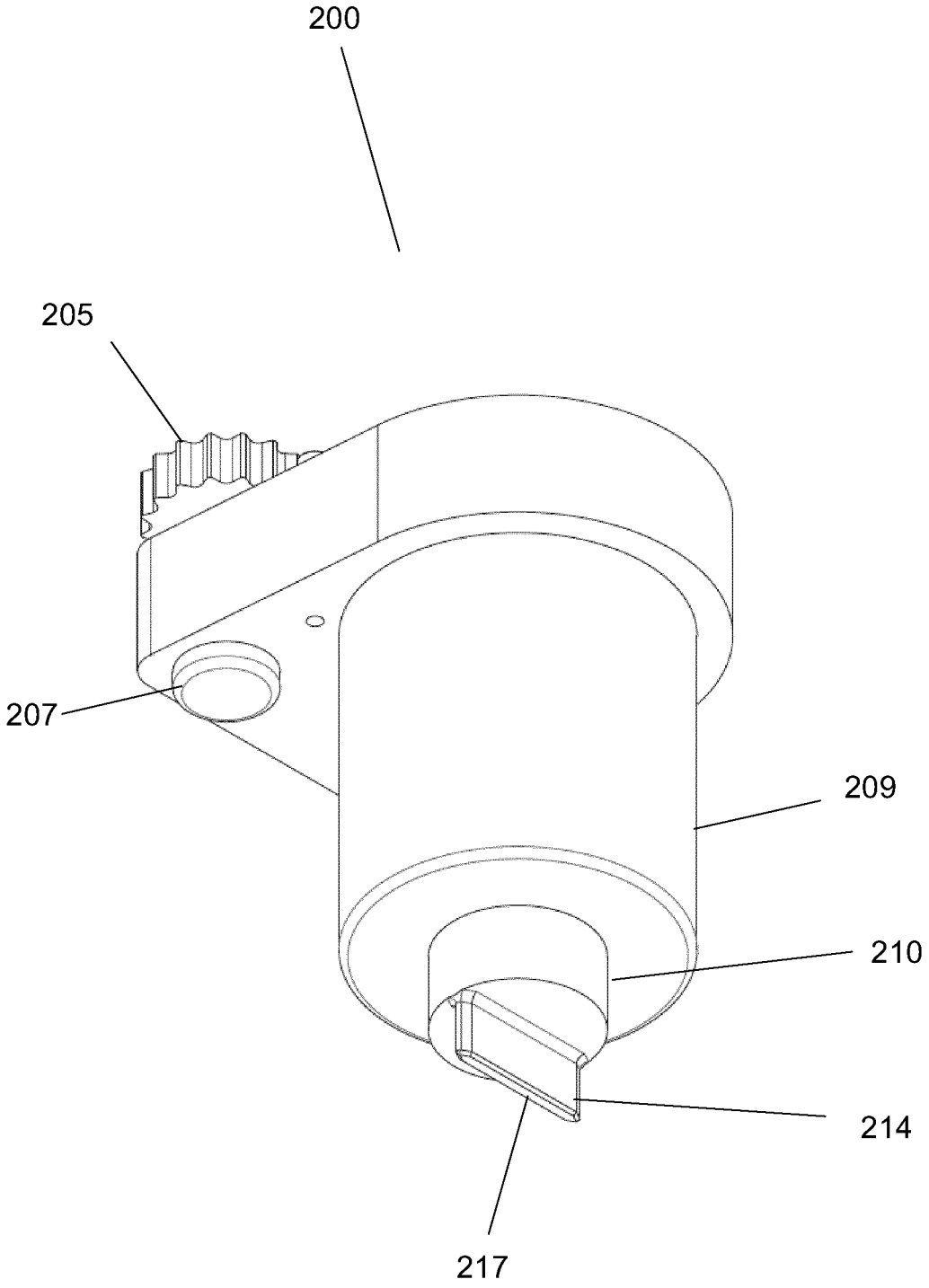
FIG. 3 is a perspective view of the valve actuator according to the invention.

FIG. 3 is an isolated perspective view of the valve actuator 200 according to the invention. FIG. 3 shows a gearwheel motor 207 for driving at least one of the gearwheels. The valve actuator 200 further includes an actuator motor (not shown) in the actuator motor housing 209. The actuator motor provides torque to a drive element 210. A valve head engagement portion 214 is mounted to the end of the drive element 210 facing the production structure 100 (see FIG. 1). The valve head engagement portion 214 is shown as a flat blade with an end surface 217 and is adapted to the design of a valve head. Other designs deviating from a flat blade may also be used as long as the valve head engagement portion 214 design is adapted to the valve head design.

The valve actuator 200 may alternatively include one single motor driving both the first gearwheel 204 and/or the second gearwheel 205 for moving the valve actuator and the drive element 210 for actuating the valves. An internal transmission system (not shown) may shift the motor between driving the gearwheel or gearwheels for moving the actuator and driving valve head engagement portion 214. Each motor included in the valve actuator 200 may include torque overload protection means such as a torque limiter.

Figure 4:
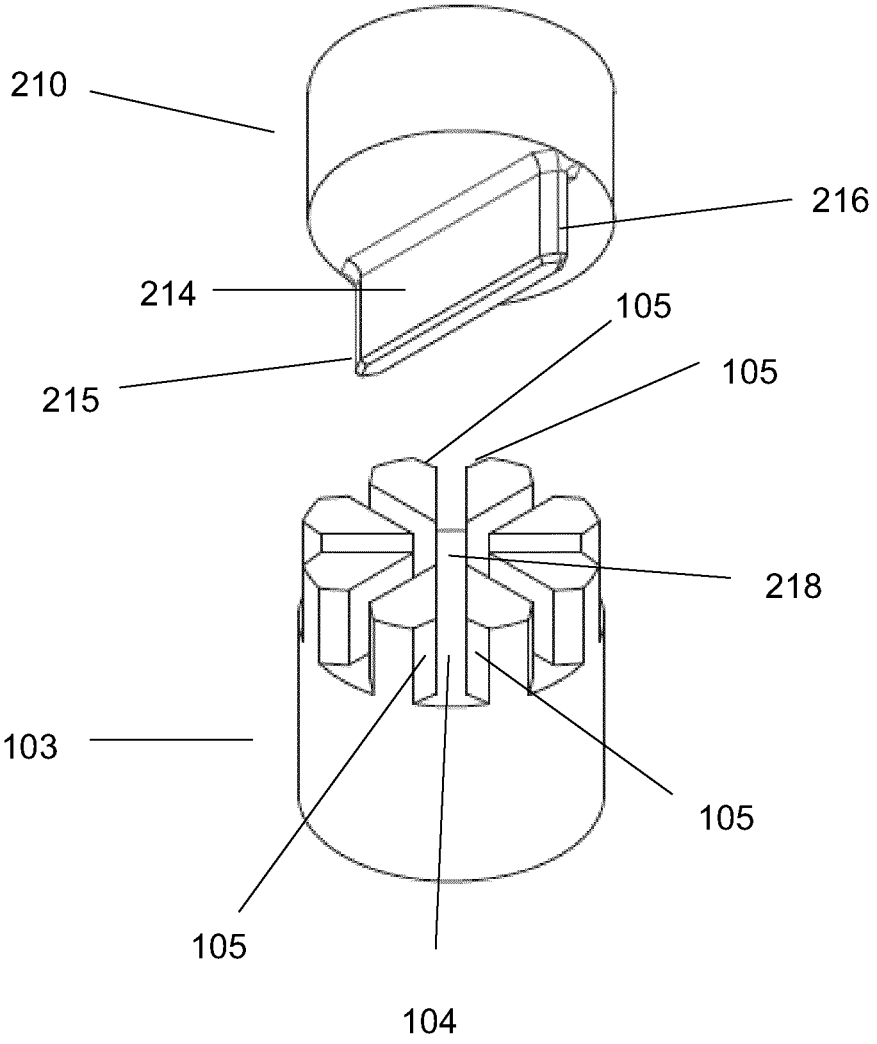
FIG. 4 is a perspective view of a drive element and a corresponding valve head.

FIG. 4 is a perspective view of the drive element 210 end section with a valve head engagement portion 214 designed as a flat blade and a corresponding valve head 103 adapted to the valve head engagement portion 214 designed as a flat blade. The valve head 103 according to FIG. 4 is substantially cylindrical and includes four diametrical slots 104 with an angle of 45° between each other forming four continuous recesses extending diametrically through the top part of the valve head 103.

The valve head 103 may alternatively have either one single diametrical slot 104 or $2^{n-1}$ diametrical slots where n=[2, 3, 4, . . . ] with an angle of $180°/2^{n-1}$ between each diametrical slot. Increasing the number of diametrical slots 104 provides the valve head with more points of entry for the valve head engagement portion 214.

In the embodiment of FIG. 4, the valve head engagement portion 214 is a flat blade shaped to fit any of the diametrical slots 104 of the valve head 103. The flat blade 214 includes a first edged end portion 215 and a second edged end portion 216. Each diametrical slot 104 has two inclined cut-away portions 105 expanding the slot thickness towards the circumference of the cylindrical valve head 103 at both ends of the slot. The edged end portions 215, 216 of the flat blade 214 and the inclined cut-away portions 105 both serve to guide the flat blade 214 into the diametrical slots 104 to facilitate entry if the flat blade 214 is not perfectly aligned with the slots 104.

The valve head engagement portion 214 may also be a mechanical claw or any other conventional gripping tool adapted to grip and rotate the valve head 103.

Figure 5:
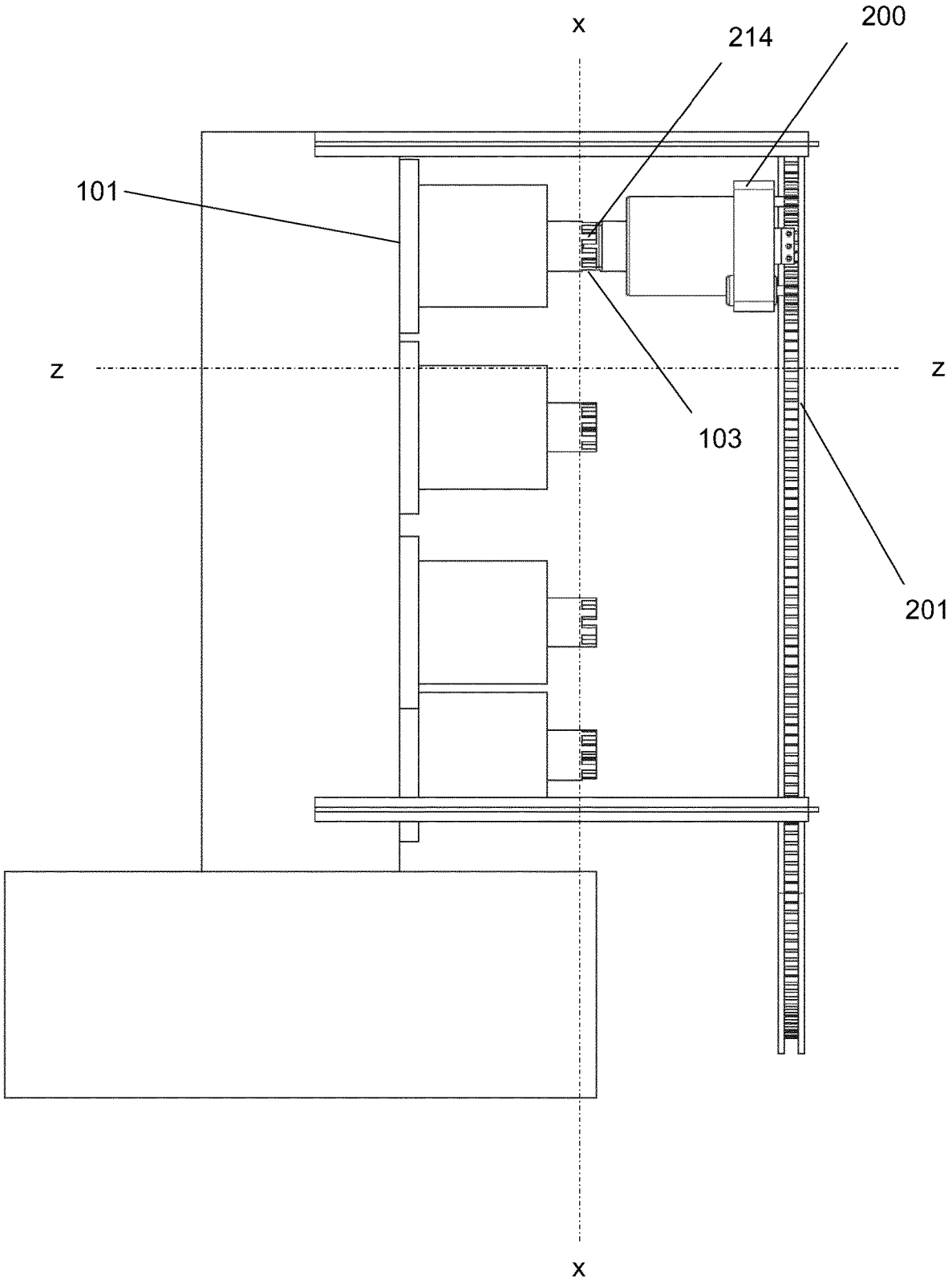
FIG. 5 is a side view of FIG. 1.

FIG. 5 is a side view of FIG. 1 showing an x-axis and a y-axis. The valve actuator 200 moves in parallel to the x-axis and may engage each valve 101 without any zaxis movement. The end surface 217 of the valve head engagement portion 214 is substantially aligned with a base surface 218 of the diametrical slots 104 of the valve head 103 (see FIG. 4).

To allow the valve actuator 200 to engage a valve head 103, a topside operator activates the gearwheel motor 207 (see FIG. 3) which causes the valve actuator 200 to move along the transport rail 201 parallel to the x-axis towards a designated valve 101. A magnetic sensor (not shown) communicates the position of the valve actuator 200 via communication means to the topside operator. The valve head engagement portion 214 is aligned with the transport rail 201 and thus a direction of travel and enters one of the diametrical slots 104 of the valve head 103 of the designated valve 101. The valve actuator 200 is stopped when a predefined position is reached, e.g. when the center of the valve head engagement portion 214 is positioned in alignment with the center of the diametrical slot 104. To actuate the designated valve 101, torque is provided by the actuator motor, rotating the valve head 103 and thereby opening or closing the valve. The valve actuator 200 is set to align the valve head engagement portion 214 parallel to the transport rail 201 after operating a valve. Once the actuation is complete, the valve actuator 200 may be repositioned to a parking position (not shown) where the valve actuator 200 is not in engagement with any of the valves.

Figure 6:
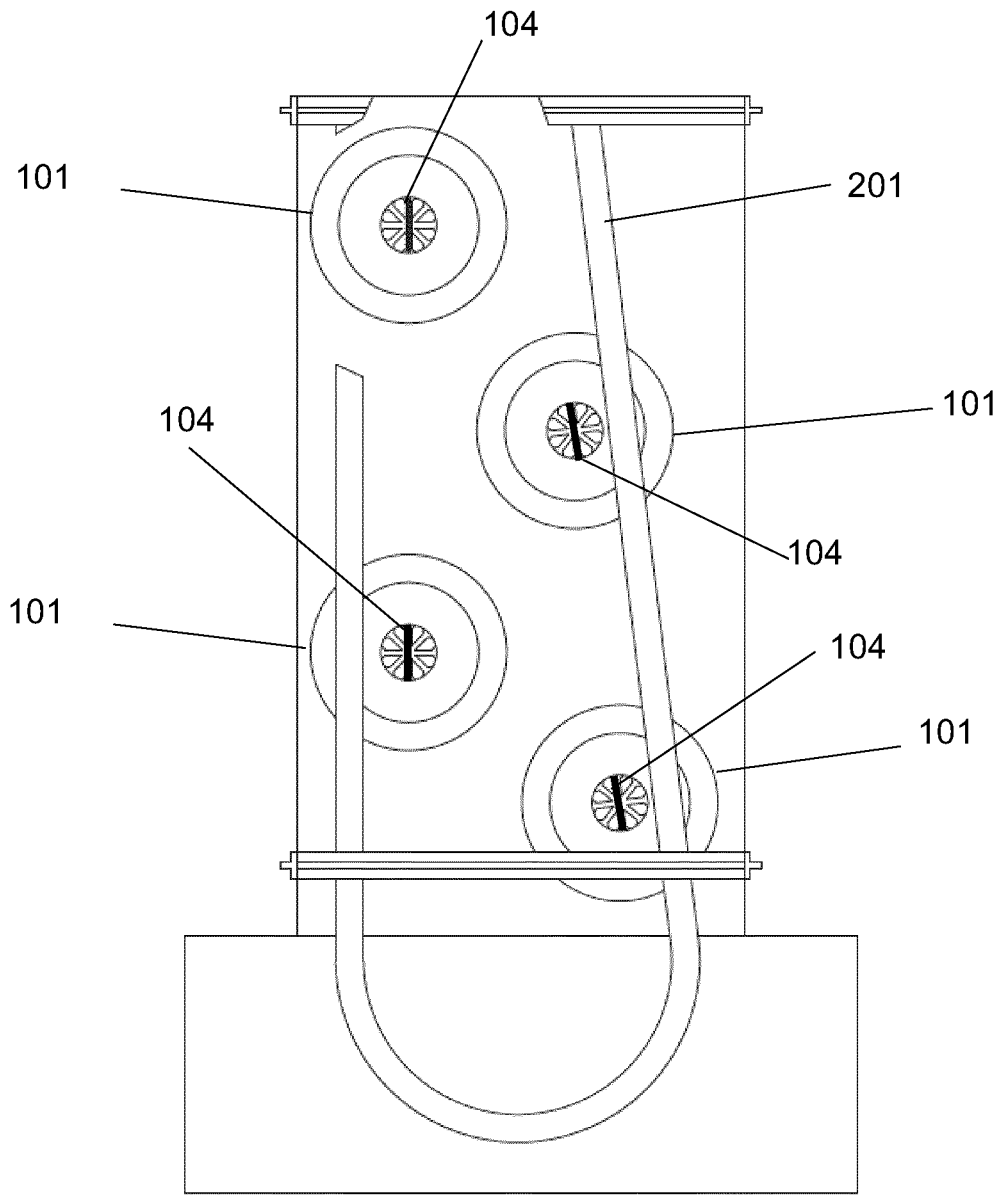
FIG. 6 is an elevation of FIG. 1 where the valve actuator is removed for clarity.

FIG. 6 is an elevation of FIG. 1 where the valve actuator is removed for clarity. The diametrical slot 104 of each valve head is highlighted with a bold stroke and shows that the diametrical slot 104 of each valve 101 is aligned with the transport rail 201. Once the valve actuator is moved out of engagement with a valve head 103, a mechanical spring release system (not shown) of the valve may rotate the valve head 103 so that a diametrical slot 104 is aligned parallel with the transport rail 201. In case the diametrical slot 104 is not aligned perfectly parallel to the transport rail 201, the edged end portions 215, 216 of the valve head engagement portion 214 and the inclined cut-away portions 105 and the multitude of diametrical slots 104 serve to guide the valve head engagement portion 214 into a diametrical slot 104 to allow a diametrical slot 104 not to be perfectly aligned with the valve head engagement portion 214 upon entry.

Description of the figure reference numbers

| | | | |
|---|---|---|---|
| 100 | Production structure | 104 | Diametrical slot |
| 101 | Valve | 105 | Inclined cut-away portion |
| 102 | Valve housing | 213 | Transport rail teeth |
| 103 | Valve head | 214 | Valve head engagement portion |
| 200 | Valve actuator | 215 | First edged end portion |
| 201 | Transport rail | 216 | Second edged end portion |
| 202 | First support frame | 217 | End surface |
| 203 | Second support frame | 218 | Base surface |
| 204 | First gearwheel | | |
| 205 | Second gearwheel | | |
| 207 | Gearwheel motor | | |
| 208 | Support clamp | | |
| 209 | Actuator motor housing | | |
| 210 | Drive element | | |
| 211 | First support pin | | |
| 212 | Second support pin | | |

The invention claimed is:

1. A valve actuator system for actuating at least two valves on a production structure having at least two valves, each valve comprising a rotatable valve head, the valve actuator system comprising:

a transport rail;

a valve actuator moveable along the transport rail, the valve actuator including at least:

a first gearwheel engaging a transport rail rack of the transport rail; and a second gearwheel engaging the transport rail rack of the transport rail;

an actuator motor housing;

a rotatable drive element with a valve head engagement portion for engaging the valve head; and at least one motor for driving at least one of the gearwheel and the rotatable drive element.

2. The valve actuator system of claim 1, wherein the production structure is a manifold or a subsea tree.

3. The valve actuator system of claim 1, wherein the actuator motor housing is filled with a fluid.

4. The valve actuator system of claim 1, wherein the valve head engagement portion includes a first end portion and a second end portion, each with chamfered corners.

5. The valve actuator system of claim 1, wherein the valve head includes either one single diametrical slot or $2^{n-1}$ diametrical slots where n=[2,3,4, . . . ] with an angle of $180°/2^{n-1}$ between each diametrical slot; and wherein an end surface of the valve head engagement portion is parallel to a base surface of the diametrical slots of the valve head.

6. The valve actuator system of claim 5, wherein each diametrical slot includes two inclined cut-away portions expanding the slot width towards the circumference of the cylindrical valve head at both ends of the slot.

7. The valve actuator system of claim 1, wherein the valve actuator includes a magnetic sensor, monitoring the position of the valve actuator along the transport rail.

8. The valve actuator system of claim 1, wherein the valve head engagement portion is a flat blade.

9. The valve actuator system of claim 1, wherein the transport rail is secured to the production structure.

10. The valve actuator system of claim 1, further comprising:

a second valve actuator identical to the valve actuator.

11. The valve actuator system of claim 1, wherein the valve actuator further comprises a support clamp aligning the valve actuator with the transport rail.

12. The valve actuator system of claim 1, wherein the valve actuator further comprises a support pin aligning the valve actuator with the transport rail.

* * * * *